US007434699B2

(12) United States Patent
Stukenberg

(10) Patent No.: US 7,434,699 B2
(45) Date of Patent: Oct. 14, 2008

(54) DISPLAY FIXTURE

(75) Inventor: Joseph R. Stukenberg, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 450 days.

(21) Appl. No.: 10/988,130

(22) Filed: Nov. 12, 2004

(65) Prior Publication Data

US 2006/0102567 A1 May 18, 2006

(51) Int. Cl.
*A47G 19/08* (2006.01)

(52) U.S. Cl. ..... 211/41.1; 211/87.01

(58) Field of Classification Search ..... 211/41.1, 211/41.2, 87.01, 57.1, 59.1, 54.1; 248/316.1, 248/488, 316.4, 490, 316.6, 491, 316.7, 302, 248/316.8, 489, 313, 311.2, 312.1, 449; D6/553, 566, 567, 467, 570, 349, 354, 367, D6/370, 372, 373

See application file for complete search history.

(56) References Cited

U.S. PATENT DOCUMENTS

| | | | | | |
|---|---|---|---|---|---|
| 1,184,246 | A | * | 5/1916 | Klein | 248/448 |
| 2,501,019 | A | * | 3/1950 | Attick | 248/448 |
| 2,508,841 | A | * | 5/1950 | Schreibman | 211/41.7 |
| 2,737,361 | A | * | 3/1956 | Petzke | 248/491 |
| 2,835,394 | A | * | 5/1958 | Seymour | 211/41.7 |
| 2,899,154 | A | * | 8/1959 | Zavolner | 248/491 |
| 3,104,491 | A | * | 9/1963 | Sparkman | 248/449 |
| 3,115,252 | A | | 12/1963 | Senical | |
| 3,140,558 | A | * | 7/1964 | Cassidy | 248/449 |
| 3,738,606 | A | * | 6/1973 | Millen | 248/449 |
| D250,379 | S | | 11/1978 | Zahn | |
| 4,223,864 | A | * | 9/1980 | Harlow | 248/490 |
| D266,461 | S | * | 10/1982 | Helzer | D6/310 |
| 4,364,537 | A | | 12/1982 | Helzer | |
| 4,448,384 | A | * | 5/1984 | Jones et al. | 248/443 |
| 4,457,484 | A | * | 7/1984 | Hameister | 248/490 |
| 4,473,207 | A | | 9/1984 | Nascher | |
| 4,542,875 | A | * | 9/1985 | DeBaun et al. | 248/491 |
| 4,542,876 | A | * | 9/1985 | Hogg | 248/491 |
| 4,856,749 | A | * | 8/1989 | Habermann | 248/448 |
| 4,957,263 | A | * | 9/1990 | Leluan, Jr. | 248/473 |
| D339,945 | S | | 10/1993 | Moser | |
| 5,257,702 | A | | 11/1993 | Grafstein | |
| 5,673,800 | A | | 10/1997 | Connolly | |
| 5,836,459 | A | | 11/1998 | Nezwek et al. | |
| D406,980 | S | | 3/1999 | Goodman | |

(Continued)

*Primary Examiner*—Jennifer E. Novosad
(74) *Attorney, Agent, or Firm*—Ingrassia Fisher & Lorenz P.C.

(57) ABSTRACT

A fixture for displaying dinnerware including a base, a track, and a dinnerware mount. The base is configured to support a piece of dinnerware. The track is coupled to and extends generally perpendicular to the base. The dinnerware mount is slidably coupled to the track and includes a first arm and a second arm circumferentially spaced from one another. Each of the first arm and the second arm define a clasp for receiving a portion of the piece of dinnerware. When the dinnerware mount is in a first position with respect to the track, the piece of dinnerware is maintained between the base and the dinnerware mount. When the dinnerware mount is in a second position with respect to the track, the piece of dinnerware is removable from between the base and the dinnerware mount. Dinnerware displays and methods of presenting dinnerware to retail audiences provide additional advantages.

26 Claims, 10 Drawing Sheets

U.S. PATENT DOCUMENTS

| | | | | |
|---|---|---|---|---|
| D414,640 | S | | 10/1999 | Goodman |
| 6,007,041 | A | | 12/1999 | Law |
| D426,737 | S | | 6/2000 | Janis |
| 6,079,574 | A | | 6/2000 | Mylander et al. |
| D431,953 | S | | 10/2000 | Walters-Dowding et al. |
| D436,486 | S | | 1/2001 | Janis |
| 6,334,540 | B1 | | 1/2002 | Plutsky |
| 6,336,563 | B1 | | 1/2002 | Floyd, Sr. |
| D479,423 | S | | 9/2003 | Mahoney |
| D495,548 | S | | 9/2004 | Goodman et al. |
| D534,004 | S | * | 12/2006 | Waniga ..... D6/300 |
| D543,759 | S | * | 6/2007 | Stukenberg ..... D6/553 |

* cited by examiner

DISPLAY FIXTURE

BACKGROUND OF THE INVENTION

Many different retail display techniques, including tables, shelves, and peg boards with various rods and brackets attached thereto, are typically used for the retail display of dinnerware. Dinnerware typically includes plates, cups, and saucers in corresponding styles, patterns, colors, etc. Accordingly, it is often desirable to display corresponding pieces together so that a prospective purchaser can better view a suggested place setting arrangement. However, such retail displays tend to require a relatively large amount of display space, thereby complicating the display of multiple place settings or groupings in a single area. Moreover, consumer handling of dinnerware can lead to inadvertent breakage or other damage, shoplifting, or other problems In other instances, dinnerware is merely displayed as a photograph or sketch on a front or side of a box containing at least one piece or place setting of the dinnerware.

SUMMARY OF THE INVENTION

One aspect of the present invention provides a fixture for displaying dinnerware including a base, a track, and a dinnerware mount. The base is configured to support a piece of dinnerware. The track is coupled to and extends generally perpendicular to the base. The dinnerware mount is slidably coupled to the track and includes a first arm and a second arm circumferentially spaced from one another. Each of the first arm and the second arm define a clasp for receiving a portion of the piece of dinnerware. When the dinnerware mount is in a first position with respect to the track, the piece of dinnerware is maintained between the base and the dinnerware mount. When the dinnerware mount is in a second position with respect to the track, the piece of dinnerware is removable from between the base and the dinnerware mount. Other features and advantages are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
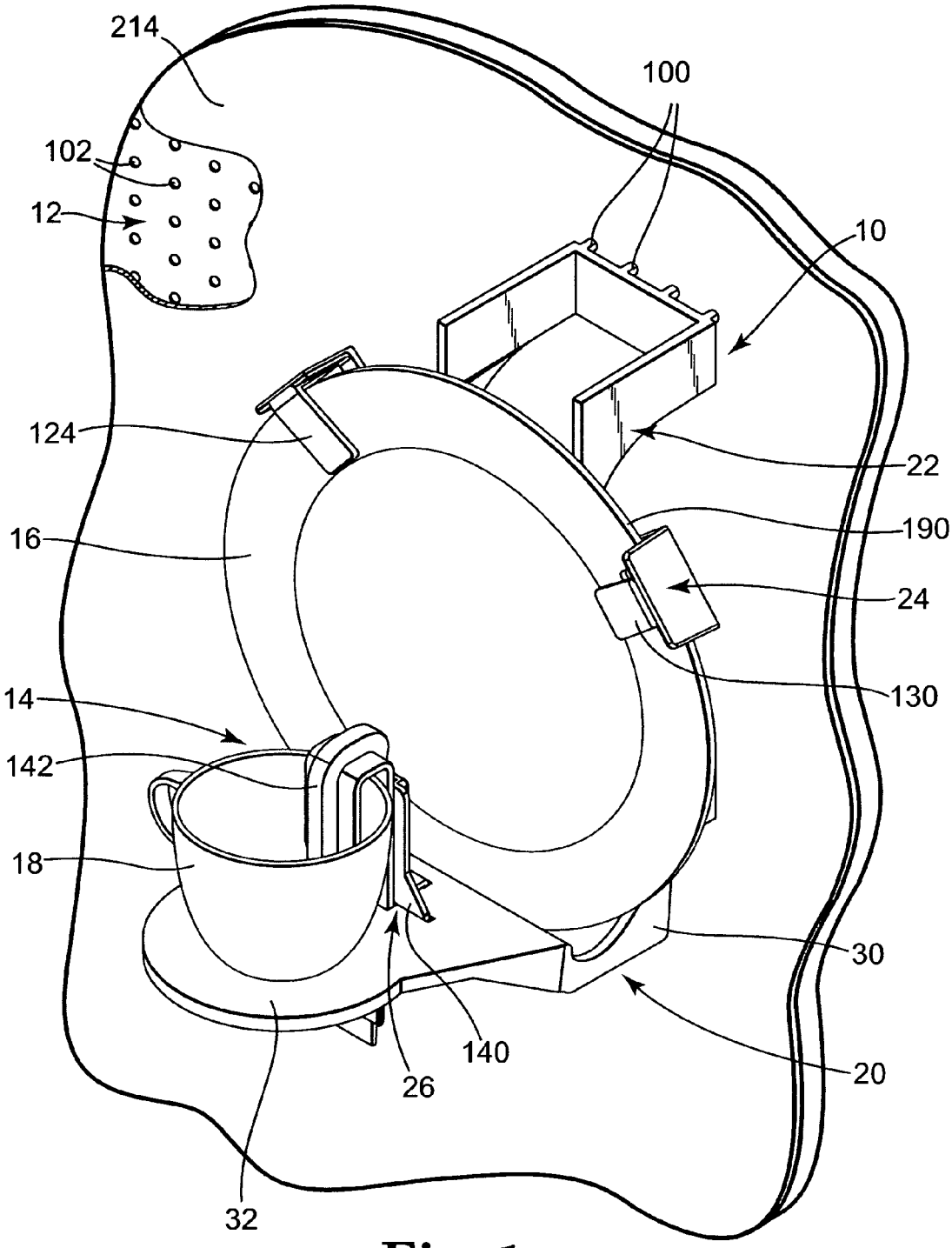
FIG. 1 is a top perspective view of one embodiment of a dinnerware fixture displaying dinnerware, according to the present invention.

One embodiment of a dinnerware fixture 10 is illustrated in FIG. 1. Dinnerware fixture 10 selectively hangs from a wall, such as a peg board wall 12, and maintains dinnerware 14 for retail display. More particularly, dinnerware 14 includes multiple pieces of tableware such as a dish or plate 16 and a cup 18 displayed in front of plate 16. In one embodiment, dish or plate 16 is a bread plate, dinner plate, dessert plate, serving plate, bowl, etc., and drinking vessel or cup 18 is a cup, glass, bowl, etc. By displaying cup 18 in front of plate 16, not only are consumers able to easily view dinnerware 14 for style, size, pattern, color, thickness, quality, etc., but consumers are also able to evaluate a hands-on look and feel of dinnerware 14. The arrangement of cup 18 in front of plate 16 saves space. In addition, dinnerware fixture 10 maintains dinnerware 14 in a manner decreasing concerns with shoplifting or breakage during consumer handling. Accordingly, dinnerware fixture 10 provides for a highly effective, hands-on display of dinnerware 14 to consumers while still providing security advantages to the retail location.

Figure 2:
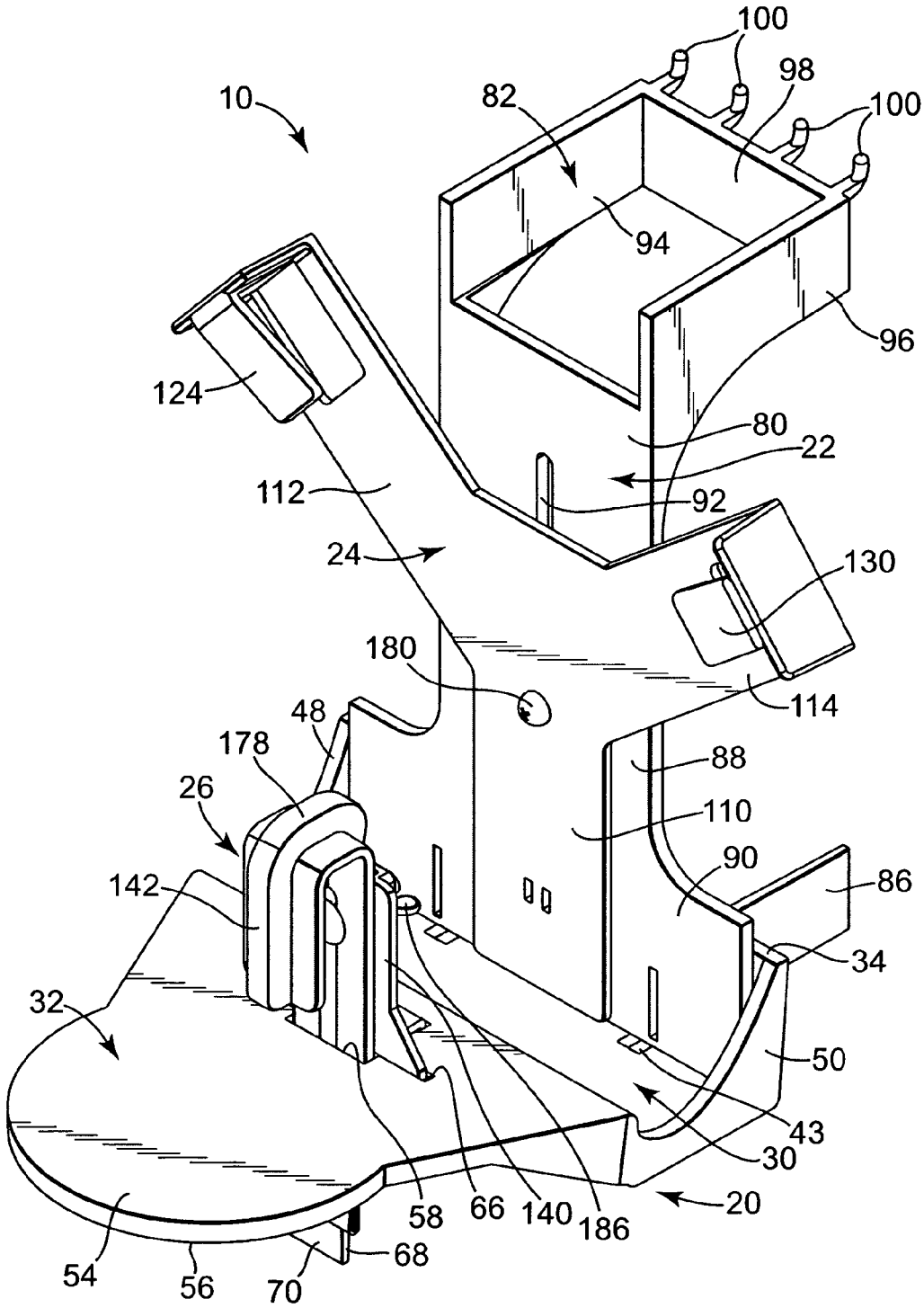
FIG. 2 is a top perspective view of one embodiment of the dinnerware fixture of FIG. 1.
Figure 3:
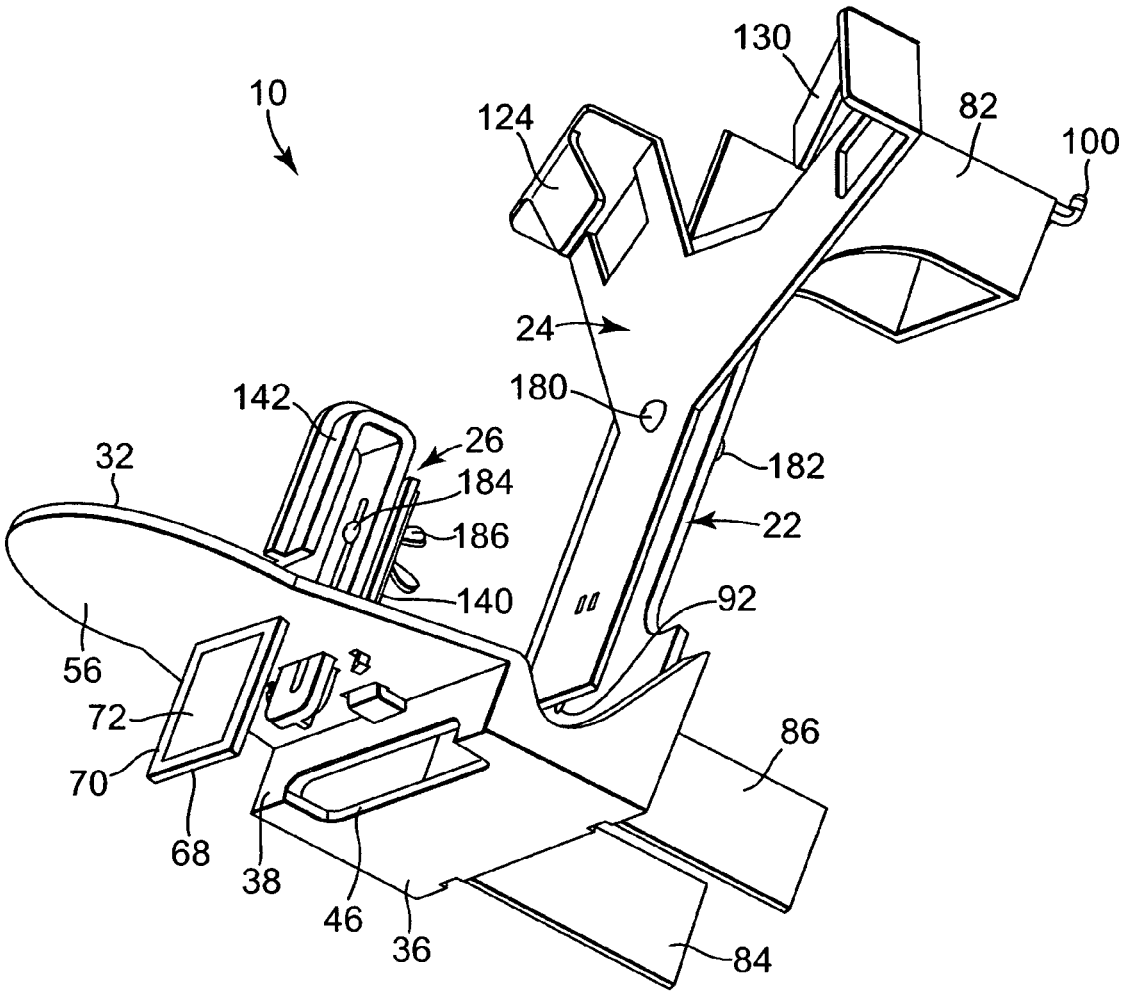
FIG. 3 is a bottom perspective view of the dinnerware fixture of FIG. 2.

As illustrated in FIGS. 2 and 3, dinnerware fixture 10 includes a base 20, a back support 22, a plate or dinnerware mount 24, and a cup or dinnerware mount 26. Base 20 and back support 22 are coupled to one another to hang from wall 12 and to support dinnerware 14. Plate mount 24 couples with back support 22 to clamp plate 16, to dinnerware fixture 10. Cup mount 26 couples with base 20 to clamp cup 18 to dinnerware fixture 10. Once plate 16 and cup 18 are clamped or secured to dinnerware fixture 10, the assembly is hung from wall 12 for display to a consumer audience.

Figure 4:
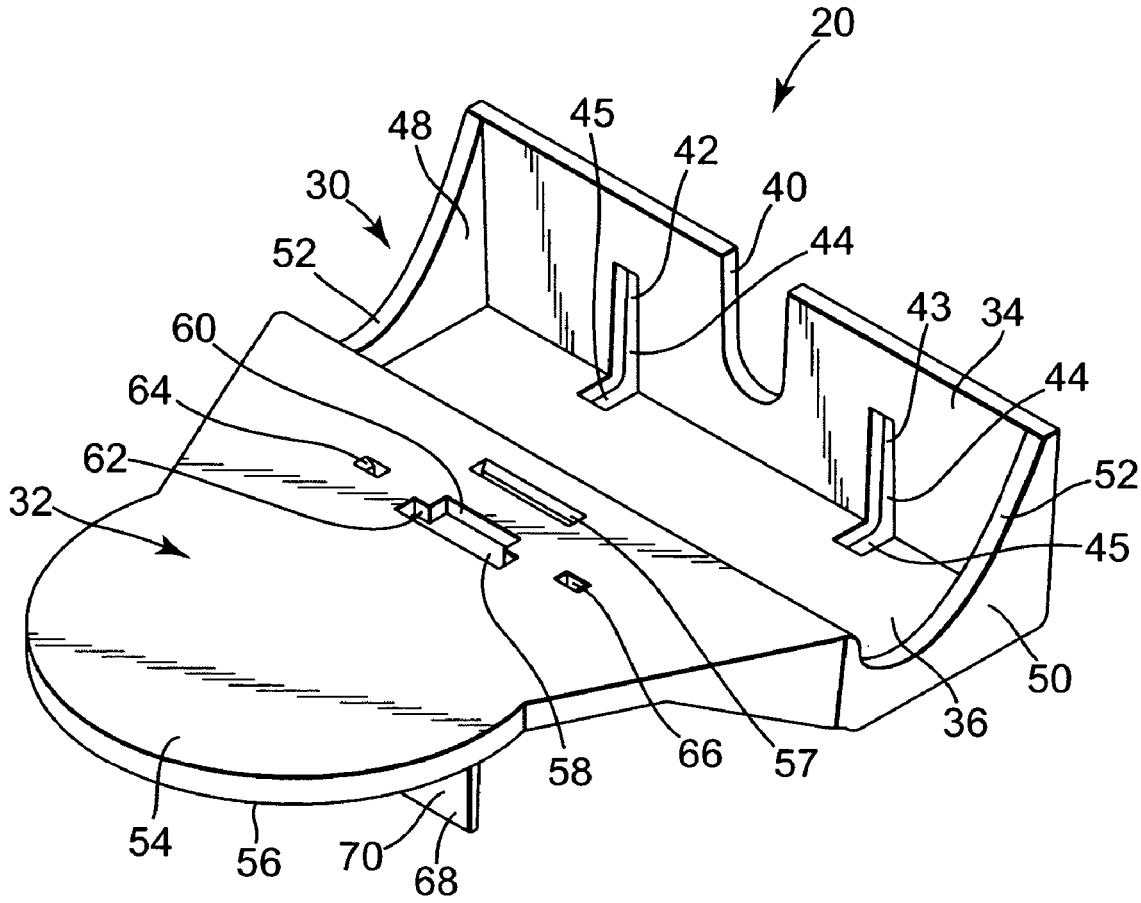
FIG. 4 is a perspective view of one embodiment of a base of the dinnerware fixture of FIG. 2.

More particularly, FIG. 4 illustrates one embodiment of base 20. Base 20 includes a plate reception portion 30 and a cup reception portion or platform 32. Plate reception portion includes a back wall 34, a bottom wall 36, and a front wall 38, as illustrated with reference to FIG. 3. In one embodiment, back wall 34, bottom wall 36, and front wall 38 are each generally planar. Bottom wall 36 extends from a bottom edge of back wall 34 with a generally perpendicular orientation. Front wall 38 extends upward from bottom wall 36 opposite back wall 34 with a generally perpendicular orientation.

Back wall 34 includes a slot 40 generally centered laterally and extending downward from an upper edge of back wall 34 opposite bottom wall 36. A pair of generally L-shaped apertures 42 and 43 are collectively defined by back wall 34 and bottom wall 36. More particularly, a long leg 44 of each aperture 42 and 43 extends from bottom wall 36 upward through a portion of back wall 34. A short leg 45 of each aperture extends from back wall 34 partially along bottom wall 36. An additional elongated aperture 46 is collectively defined laterally along the intersection between bottom wall 36 and front wall 38.

In one embodiment, plate reception portion 30 includes a first side wall 48 and a second side wall 50. Each side wall 48 and 50 extends front to back between back wall 34, bottom wall 36, and front wall 38 opposite one another. In one embodiment, each side wall 48 and 50 defines an upper edge 52 opposite bottom wall 36 having a slope or curvature to facilitate reception of plate 16 as will be further described below. Side walls 48 and 50 contribute to the overall rigidity of base 20. With the above in mind, plate reception portion 30 is generally formed as an open box or cavity.

Cup reception platform 32 extends forward from an upper edge of front wall 38 opposite bottom wall 36. More particularly, in one embodiment, cup reception platform 32 extends in a generally planar manner to define a top surface 54 and a bottom surface 56. In one embodiment, cup reception platform 32 tapers forward from plate reception portion 30 and/or terminates in a circular or curvilinear manner opposite plate reception portion 30. In one embodiment, a rectangular aperture 57 is laterally centered near the back of and extends through the entire thickness of cup reception platform 32. Rectangular aperture 57 is orientated to extend in a generally lateral direction.

In one embodiment, a generally T-shaped aperture 58 is laterally centered on and extends through the entire thickness of cup reception platform 32. T-shaped aperture 58 is positioned in front of rectangular aperture 57 and is orientated with a longitudinally extending portion 60 extending back from a laterally extending portion 62 toward rectangular aperture 57. A first side aperture 64 is laterally spaced to one side of T-shaped aperture 58. A second side aperture 66 is laterally spaced to the opposite side of T-shaped aperture 58.

In one embodiment, as illustrated in FIG. 3, cup reception platform 32 includes a label or sign support member 68 extending downwardly from bottom surface 56. Sign support member 68 is generally planar, is laterally centered on cup reception platform 32, and is positioned in front of apertures 57, 58, 64, and 66. Sign support member 68 defines a generally planar display face 70 facing forward and configured to receive a sign or label 72 including indicia relating to the type, style, brand, price, etc. of dinnerware 14 to be displayed within dinnerware fixture 10.

Figure 5A:
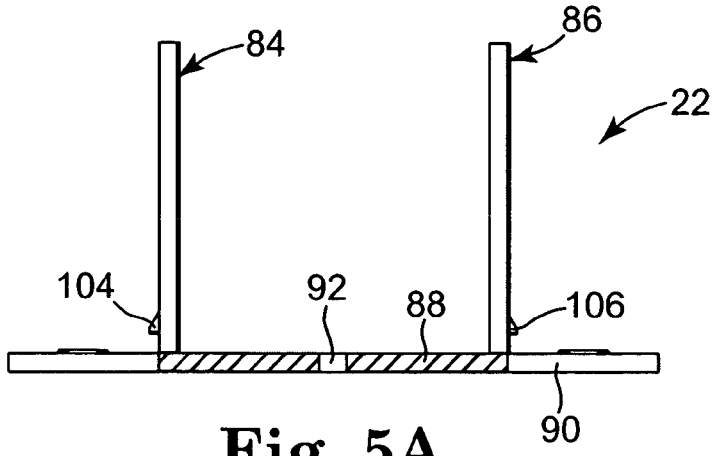
FIG. 5A is a cross-sectional view of FIG. 5 taken along the line 5A-5A.
Figure 5:
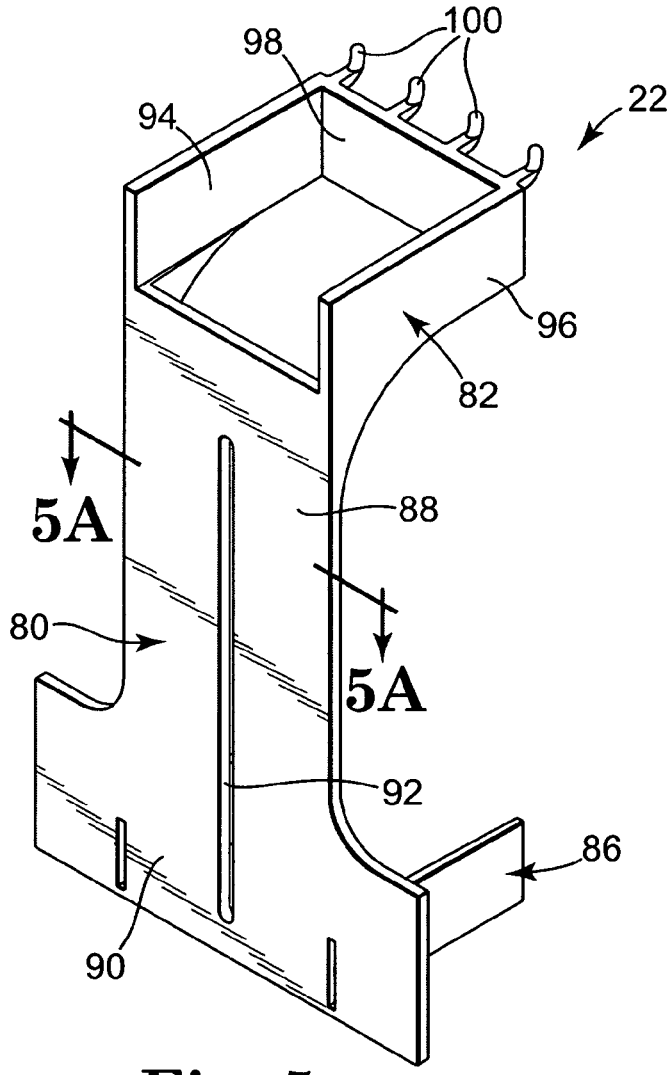
FIG. 5 is a perspective view of one embodiment of a back support of the dinnerware fixture of FIG. 2.

FIG. 5 illustrates one embodiment of back support 22. Back support 22 includes a main member 80, a wall interface portion 82, a first spacer 84, and a second spacer 86. Main member 80 is generally planar and defines a vertically elongated spine or track portion 88 and a laterally extending portion 90. Spine portion 88 is generally laterally centered with respect to and extends upward from laterally extending portion 90. An elongated slot 92 extends entirely through the thickness of main member 80 and vertically through a portion of spine portion 88 and laterally extending portion 90. In one embodiment, slot 92 is generally laterally centered with respect to spine portion 88 and laterally extending portion 90.

Wall interface portion 82 generally extends backward from spine portion 88 opposite laterally extending portion 90. In one embodiment, wall interface portion 82 defines a first side wall 94, a second side wall 96, and a back wall 98. Each side wall 94 and 96 extends backward from an opposite side edge of spine portion 88. Back wall 98 extends between side walls 94 and 96 opposite spine portion 88. In one embodiment, back wall 98 is spaced from spine portion 88 a distance in the range of about 1 inch to about 4 inches.

Wall interface portion 82 includes a plurality of pegs or hooks 100 extending from back wall 98 and configured to be received by adjacent holes 102 in wall 12 as illustrated with reference to FIG. 1. In one embodiment, each peg 100 extends back from back wall 98 and curves upward toward an end opposite back wall 98. In one example, pegs 100 are spaced apart from each other about 1 inch on center or other distance suitable to interact with a peg board or wire fixture as will be further described below.

Each spacer 84 and 86 extends back from laterally extending portion 90 a similar distance as wall interface portion 82 extends back from laterally extending portion 90. In one embodiment, each spacer 84 and 86 extends from laterally extending portion 90 a distance in the range of about 1 inch to about 4 inches. First spacer 84 is laterally spaced from second spacer 86, and each spacer is generally planar. In one embodiment, first and second spacers 84 and 86 collectively are generally laterally centered on laterally extending portion 90. In one embodiment, as illustrated with reference to the cross-sectional view of FIG. 5A, each spacer 84 and 86 includes a tab 104 and 106, respectively, positioned near laterally extending portion 90 on the outside of each spacer 84 and 86 (i.e., positioned on each spacer 84 and 86 on a surface opposite the other spacer 84 or 86, respectively).

Figure 6A:
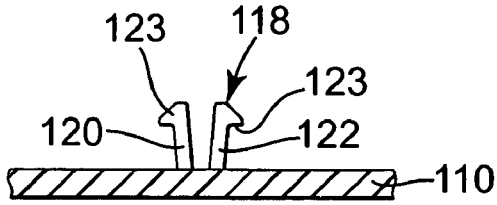
FIG. 6A is a cross-sectional view of FIG. 6 taken along the line 6A-6A.
Figure 6:
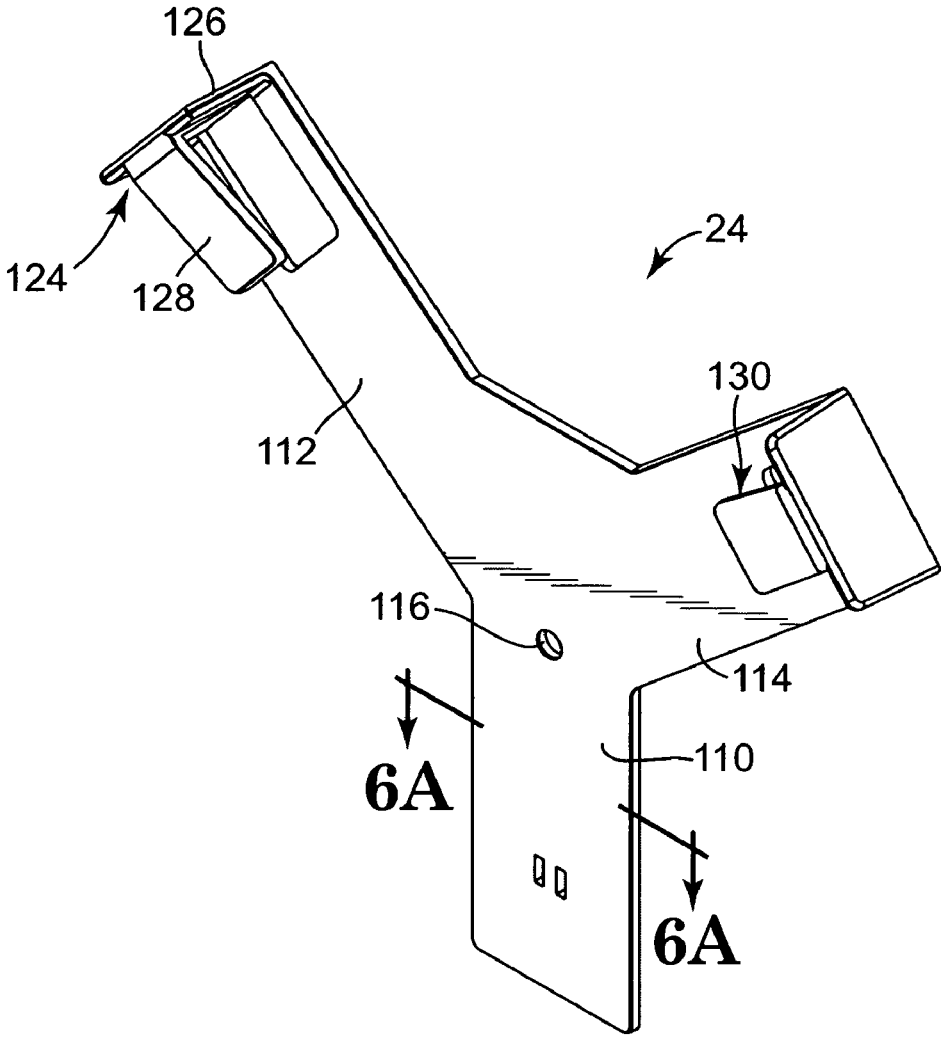
FIG. 6 is a perspective view of one embodiment of a plate mount of the dinnerware fixture of FIG. 2.

FIG. 6 illustrates one embodiment of plate mount 24. Plate mount 24 includes a first arm 110, a second arm 112, and a third arm 114 each radially extending from a common point or center to form a generally Y-shaped plate mount 24. An aperture 116 is defined at or near the common point or center of plate mount 24. First arm 110 extends down in a generally vertical direction from second and third arms 112 and 114. As illustrated with reference to FIG. 6A, a clip 118 extends back from first arm 110. In one embodiment, clip 118 is bifurcated into two portions 120 and 122 laterally positioned with respect to the other and each biased to away from the other. Each clip portion 120 and 122 defines a tab or hook 123 opposite first arm 110 and extend away from the other clip portion 120 or 122. In one embodiment, clip 118 is formed with some give allowing clip portions 120 and 122 to each selectively bend inward toward each other upon an application of suitable force. However, clip portions 120 and 122 are biased to extend outward (i.e. away from each other).

Second arm 112 extends from near center point of plate mount 24 with an angled orientation extending partially upward and partially laterally outward. A clasp 124 is defined at an end of second arm 112 opposite aperture 116. In one embodiment, clasp 124 includes a first clasp portion 126 and a second clasp portion 128. First clasp portion 126 extends forward from end of second arm 112. Second clasp portion 128 extends generally inward back toward aperture 116 and slightly angled backward toward the remainder of second arm 112. First clasp portion 126 is coupled to end of second arm 112 with suitable give or flexibility such that first clasp portion 126 is allowed to slightly rotate or bend about the intersection between end of second arm 112 and first clasp portion 126 upon the application of a suitable force to first clasp portion 126. Second clasp portion 128 is similarly formed with suitable give to allow slight rotation or bending about the intersection between first clasp portion 126 and second clasp portion 128 upon the application of sufficient force.

Third arm 114 extends from center point of plate mount 24 with an angled orientation extending partially upward and partially laterally outward opposite second arm 112. A clasp 130, similar to clasp 124, is defined at an end of second arm 112 opposite aperture 116. Accordingly, arms 110, 112, and 114 are circumferentially spaced from one another. In one embodiment, arms 110, 112, and 114 are positioned to form and angle between each of the adjacent arms 110, 112, and 114 in the range of about 120° to about 160°. In one embodiment, first arm 110 is positioned about 130° from each of second and third arms 112 and 114. Alternatively, arms 110, 112, 114 are positioned in any other arrangement suitable to maintain plate 16, as will be further described below.

Figure 7A:
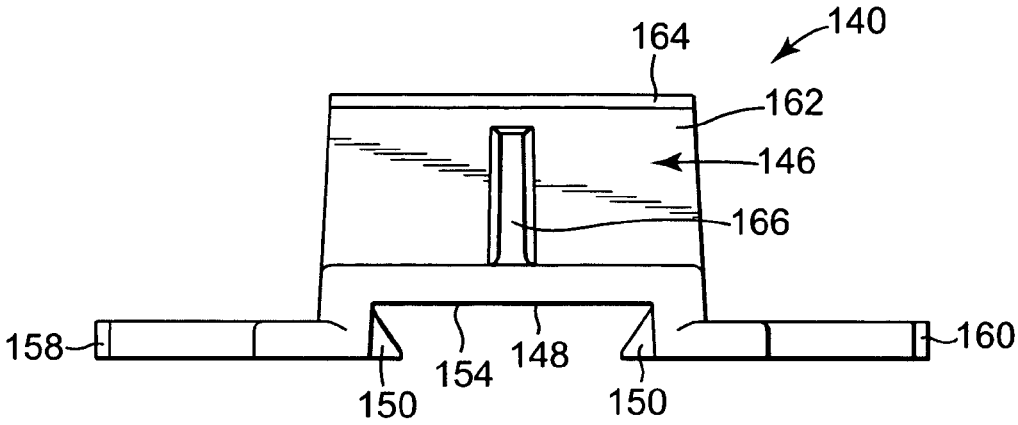
FIG. 7A is a top view of the cup mount support of FIG. 7.
Figure 7:
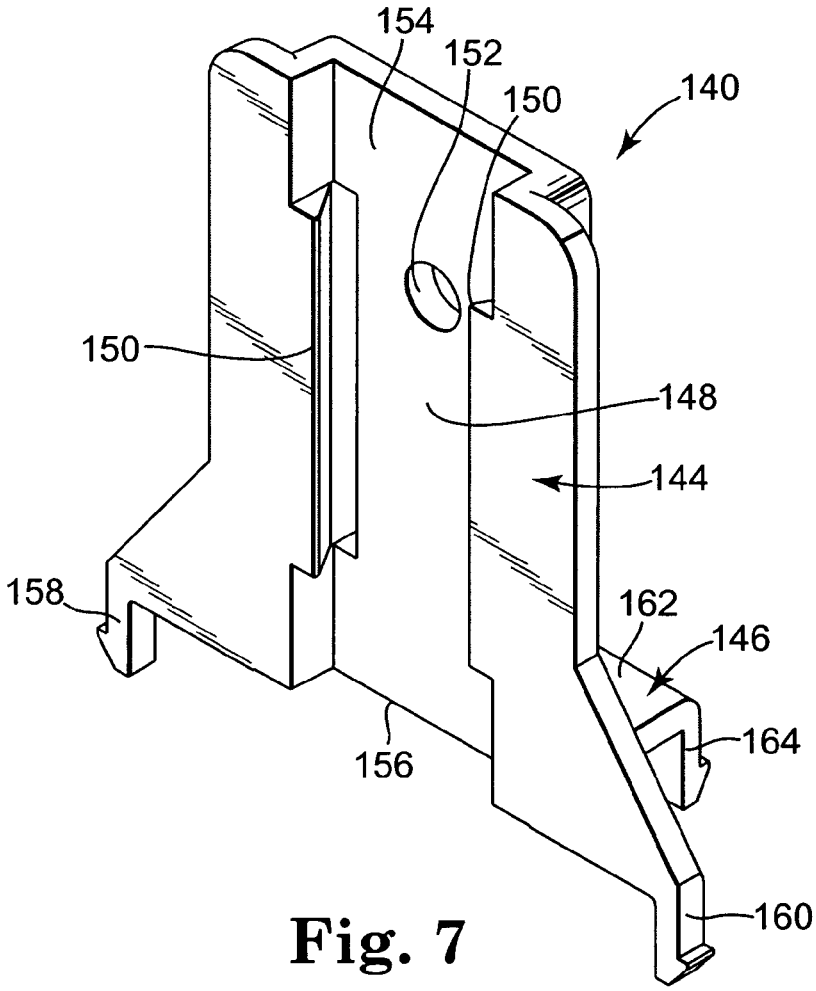
FIG. 7 is a perspective view of one embodiment of a cup mount support of the dinnerware fixture of FIG. 2.

Referring once again to FIGS. 1-3, cup mount 26 includes a cup mount support 140 and a cup mount clamp or hook 142. One embodiment of a cup mount support 140 is illustrated in FIGS. 7 and 7A. Cup mount support 140 defines a main, generally vertical portion 144 and a secondary portion 146. Main portion 144 defines a generally vertical groove 148 extending throughout the center of main portion 144. An elongated tab 150 extends along each side edge of groove 148 and protrudes toward the opposite side edge of groove 148. As such, each tab 150 extends inward and over a portion of groove 148. An aperture 152 is defined through a back wall 154 of groove 148.

Main portion 144 defines a bottom edge 156, and a first hook or tab 158 and a second hook or tab 160 each extending downward from bottom edge 156. Second hook 160 is spaced from first hook 158 such that hooks 158 and 160 are positioned opposite one another. In one embodiment, each hook 158 and 160 is formed with suitable give or flexibility to bend slightly inward from bottom edge 156 upon application of a suitable force while maintaining a bias to extend vertically downward or slightly outward from bottom edge 156.

In one embodiment, secondary portion 146 includes a first section 162 and an elongated hook or tab 164. First section 162 extends back from bottom edge 156 of main portion 144 in a generally horizontal manner. Elongated hook 164 extends from first section 162 opposite main portion 144 in a generally downward manner. In one embodiment, elongated hook 164 extends downward from first section 162 a similar distance as hooks 158 and 160 extend downward from bottom edge 156 of main portion 144. Elongated hook 164 is formed with suitable give or flexibility to bend forward about its intersection with first section 162 upon the application of a suitable force while being biased to extend vertically downward or slightly backward from first section 162. In one example, a brace 166 extends from a top surface of first section 162 upward to interface with a back surface of main portion 144 to provide additional rigidity to cup mount support 140. In one embodiment, brace 166 is generally triangularly shaped.

Figure 8:
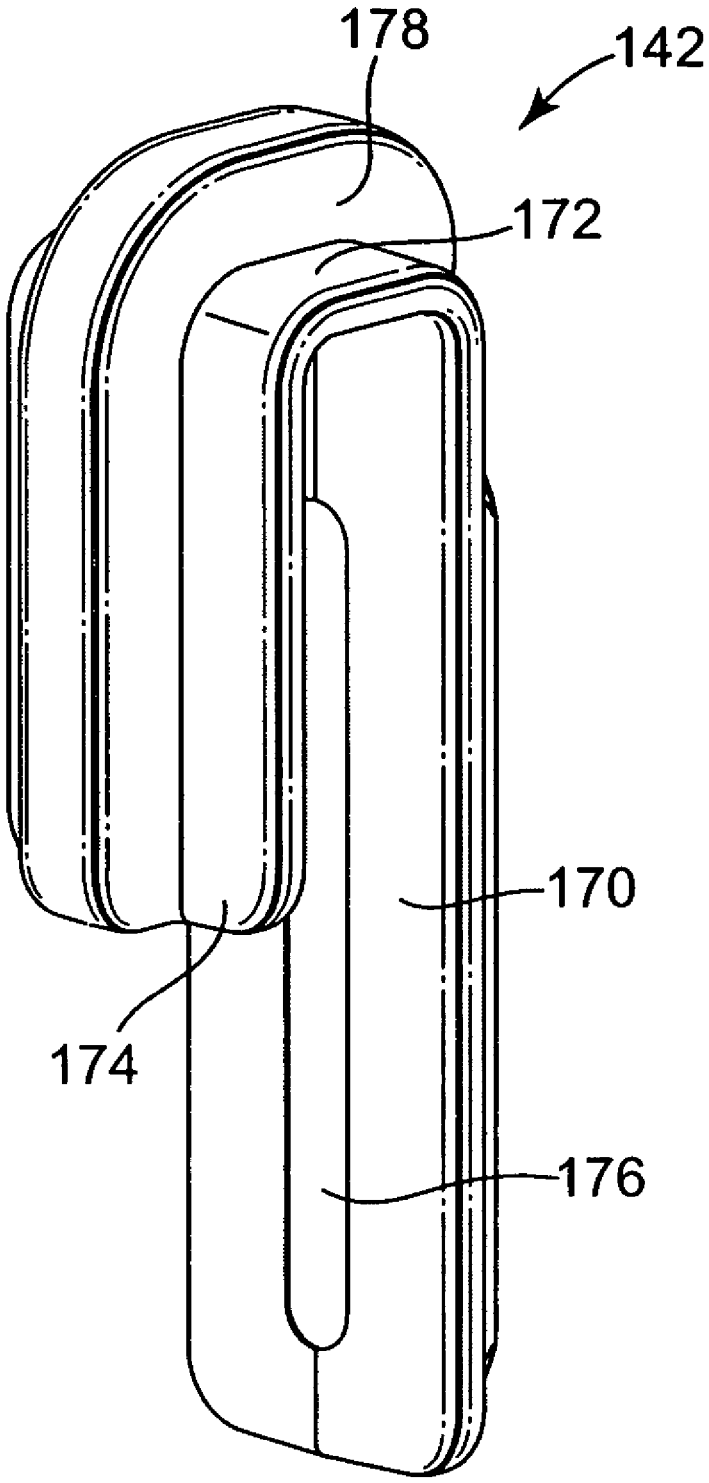
FIG. 8 is a perspective view of a cup mount hook of the dinnerware fixture of FIG. 2.

FIG. 8 illustrates one embodiment of a cup mount hook 142. In one embodiment, hook 142 is generally U-shaped and includes a back, generally vertical support 170, an intermediate, generally horizontal section 172, and a front, vertical section 174. Back support 170 has a width sized to fit within groove 148 of cup mount support 140 (illustrated in FIGS. 7 and 7A). Intermediate section 172 extends from a top of back support 170, and front section 174 extends downward from intermediate section 172 opposite back support 170. In one embodiment, back support 170 is spaced from front section 174 a distance sufficient to receive a side wall of cup 18 having any one of various thickness and radiuses. In one example, the distance between back support 170 and front section 174 is about 0.5 inch to about 0.8 inch.

Back support 170 includes an elongated slot 176 extending generally vertically along a center of back support 170. In one embodiment, a rib 178 extends along the center of the outside surface of the entire hook 142. Rib 178 provides extra rigidity to hook 142. In one example, rib 178 extends along the back center of back support 170 around each side of slot 176, over the top of intermediate section 172, and along the front of front section 174.

In one embodiment, each of base 20, back support 22, plate mount 24, cup mount support 140, and cup mount hook 142 is individually formed of injection molded plastic, such as polycarbonate, or other suitable material. In one embodiment, each piece 20, 22, 24, 140, and 142 is formed of a generally clear or transparent material so as to lessen distractions to a consumer viewing dinnerware 14.

Referring to FIGS. 2 and 3 upon assembly of dinnerware fixture 10, back support 22 is coupled to base 20. More specifically, in one embodiment, each spacer 84 and 86 is placed within the cavity of plate reception portion 30 and aligned with L-shaped apertures 42 and 43. Spacers 84 and 86 are pushed from front to back through L-shaped apertures 42 and 43, respectively, until each tab 104 and 106 passes through the respective aperture 42 and 43 to effectively clamp back wall 34 between laterally extending portion 90 and each tab 104 and 106 thereby securing back support 22 to base 20. With this in mind, base 20 and back support 22 are assembled via a snap-fit connection.

Plate mount 24 is coupled to back support 22. In particular, in one embodiment, plate mount 24 is positioned with respect to back support 22 to align aperture 116 and clip 118 with slot 40. Once aligned, plate mount 24 is pushed toward back support 22 to force clip 118 through slot 40, wherein clip portions 120 and 122 bend toward each other to slide through slot 40. Further application of force pushes clip portions 120 and 122 further through slot 40, and clip portions 120 and 122 bend back to their biased position to partially secure plate mount 24 to back support 22. Accordingly, plate mount 24 is at least partially coupled with back support 22 via a snap-fit connection.

An adjustable fastener 180, such as a bolt, screw, etc., is thread from front of plate mount 24, through aperture 116, and through slot 40 to back of back support 22. A nut, wing nut, or other fastener interface piece 182 is placed on fastener 180 from back of back support 22 to secured plate mount 24 to back support 22. In one embodiment, when fastener interface piece 182 is loosened, plate mount 24 can be selectively slid along slot 40 to vertically adjust the height clasps 124 and 130 are spaced from base 20. Once plate mount 24 is positioned as desired, fastener interface piece 182 is tightened upon fastener 180 to secure plate mount 24 in place with respect to base 20 and back support 22. In one embodiment, elongated aperture 46 is provided in back wall 34 of base 20 so as not to block or interfere with movement of clip 118 along slot 40 and the corresponding movement of plate mount 24 along back support 22.

Cup mount support 140 is coupled to base 20. More particularly, in one embodiment, cup mount support 140 is positioned to align hooks 158, 160, and 164 with apertures 64, 66, and 58, respectively. Application of downward pressure on cup mount support 140 forces hooks 158, 160, and 164 through the respective apertures 64, 66, and 58 where hooks 158 and 160, and 164 are slightly bent to pass through aperture 64, 66, and 58 and upon full passage, unbend to their biased position to secure cup mount support 140 to base 20, more particularly, to cup reception platform 32. Accordingly, cup mount support 140 extends above cup reception platform 32 in a generally upward, manner, perpendicular to cup reception platform 32.

Cup mount support 140 selectively receives cup mount hook 142. More specifically, back support 170 of cup mount hook 142 is received within groove 148 of cup mount support 140 and held between back wall 154 and tabs 150. The position of hook 142 is adjustable up and down within groove 148. A fastener 184, similar to fastener 180 is thread through slot 176 in hook 142 and through aperture 152 of back wall 154 of cup mount support 140. A fastener interface piece 186, similar to fastener interface piece 182, such as a wing nut, is coupled to back of fastener 184 to clamp hook 142 in position along cup mount support 140.

Upon assembly of dinnerware fixture 10, dinnerware 14 is placed on dinnerware fixture 10. More specifically, plate mount 24 is raised with respect to back support 22 and plate 16 is positioned on base 20 so a portion of a plate perimeter edge 190 is received within elongated aperture 46 of plate reception portion 30. Plate 16 is leaned back from aperture 46 to rest back upon plate mount 24. Plate mount 24 is adjusted upon back support 22 to a height in which opposite portions of plate edge 190 are received within clasps 124 and 130 of plate mount 24. As such, plate 16 is clamped between claps 124 and second arm 112 and clasp 130 and third arm 114. In one embodiment, clasps 124 and 130 selectively bend slightly outward upon application of a suitable force to facilitate placement of plate 16 between clasps 124 and 130 and arms 112 and 114. Once positioned to securely maintain plate 16 on dinnerware fixture 10, fastener interface piece 182 is tightened to fastener 180 to securely hold plate mount 24 in the selected position, thereby securing plate 16 to dinnerware fixture 10.

Cup mount hook 142 is raised with respect to or removed from cup mount support 140, and cup 18 is placed upon cup reception platform 32 in front of cup mount support 140. Cup mount hook 142 is coupled with cup mount support 140 by placing vertical support 170 within groove 148 between back wall 154 and tabs 150. Cup mount hook 142 is slid down through groove 148 to receive side wall of cup 18 between vertical support 170 and front section 174. Once positioned to receive side wall of cup 18, fastener interface piece 186 is tightened to fastener 184 to secure cup mount hook 142 to cup mount support 140, thereby securing or clamping cup 19 between cup mount hook 142 and cup reception platform 32.

Dinnerware fixture 10 with plate 16 and cup 18 is mounted to peg board wall 12. In particular, dinnerware fixture 10 is positioned so each peg 100 is received by a corresponding hole 102 in peg board wall 12. Once pegs 100 are positioned within peg board wall 12, dinnerware fixture 10 is rotated down until spacers 84 and 86 interact with wall 12 opposite base back wall 34. In one embodiment, wall interface portion 82 and spacers 84 and 86 are sufficiently long to allow dinnerware fixture 10 to be hung after plate 16 is secured to dinnerware fixture 10 without causing plate 16 to hit wall 12 when dinnerware fixture 10 is tilted to align pegs 100 with holes 102. In one embodiment, dinnerware fixture 10 is mounted onto a wire fixture (not illustrated) including a plurality of generally horizontal and generally parallel wires. In this embodiment, pegs 100 are positioned between two of the parallel wires to hang dinnerware fixture 10 from the wire fixture.

Dinnerware fixture 10 is hung on wall 12 such that main member 80 of back support 22 has a generally vertical orientation. In one embodiment, plate 16 and cup 18 are not easily removable from dinnerware fixture 10 while hung on wall 12 in order to deter consumers from removing plate 16 and cup 18 for general handling, inspection, or other purposes. In an alternative embodiment, plate 16 and cup 18 are secured to dinnerware fixture 10 after dinnerware fixture 10 is hung from wall 12. In one embodiment, label or sign 72 is placed on display face of base 20 either before or after dinnerware fixture 10 is hung from wall 12.

Figure 9:
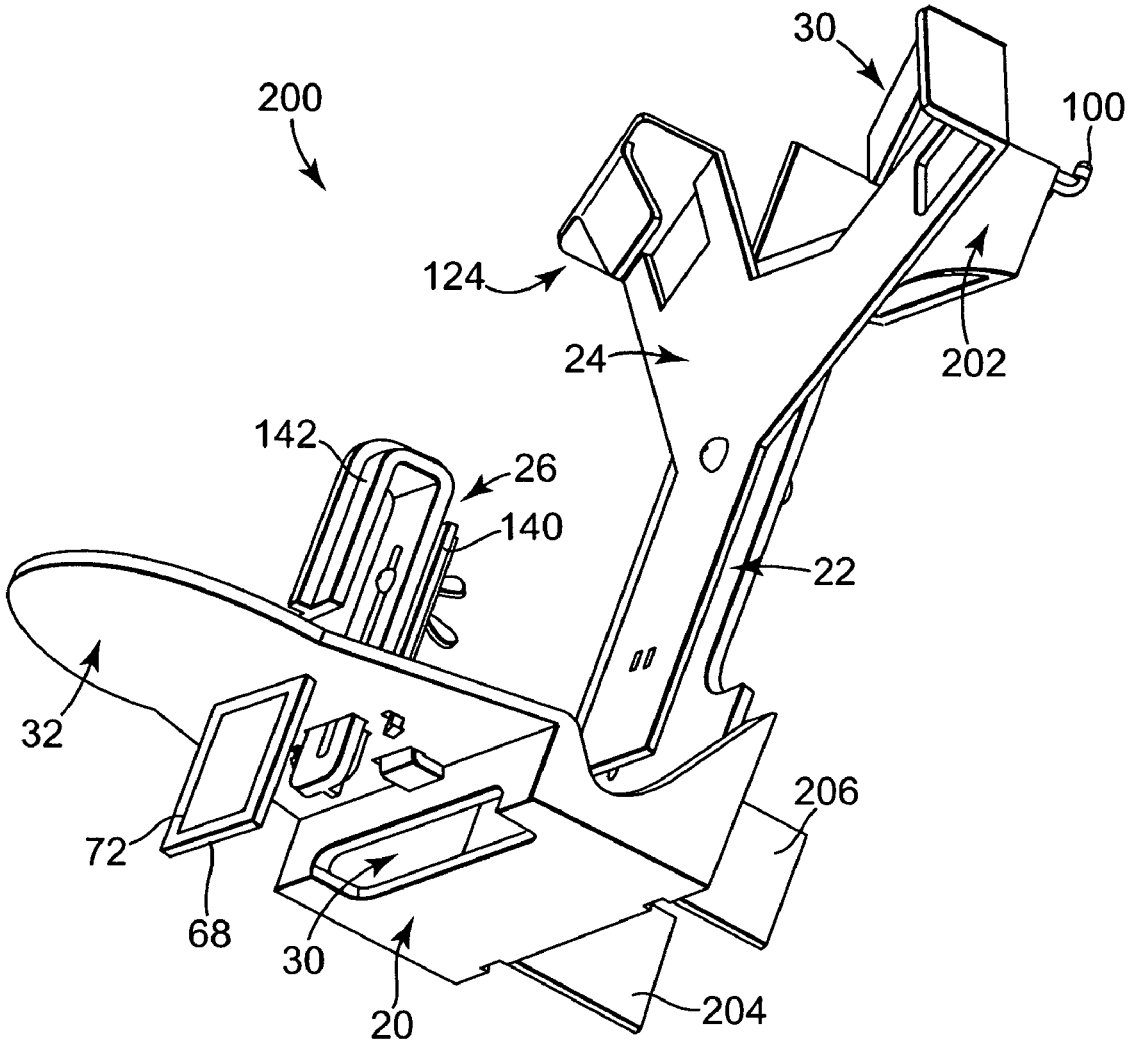
FIG. 9 is a perspective view of one embodiment of a back support of a dinnerware fixture, according to the present invention.

With reference to FIG. 9 in view of FIG. 3, in one embodiment, dinnerware fixture 10 described above is a deep dinnerware fixture 10, and a second, shallow dinnerware fixture 200 is also or alternatively assembled. Shallow dinnerware fixture 200 is similar to deep dinnerware fixture 10 except for those differences described herein. Dinnerware fixture 200 includes a wall interface portion 202 and spacers 204 and 206 similar to wall interface portion 82 and spacers 84 and 86 of dinnerware fixture 10. However, wall interface portion 202 and spacers 204 and 206 do not extend as far from main member 80 of back support 22 in shallow dinnerware fixture 200 as wall interface portion 82 and spacers 84 and 86 extend from main member 80 of back support 22 in deep dinnerware fixture 10. With this in mind, dinnerware fixture 200 holds plate 16 and cup 18 closer to wall 12 than the distance dinnerware fixture 10 holds plate 16 and cup 18 from wall 12 as illustrated with reference to a dinnerware display 210 of FIG. 10.

Figure 10:
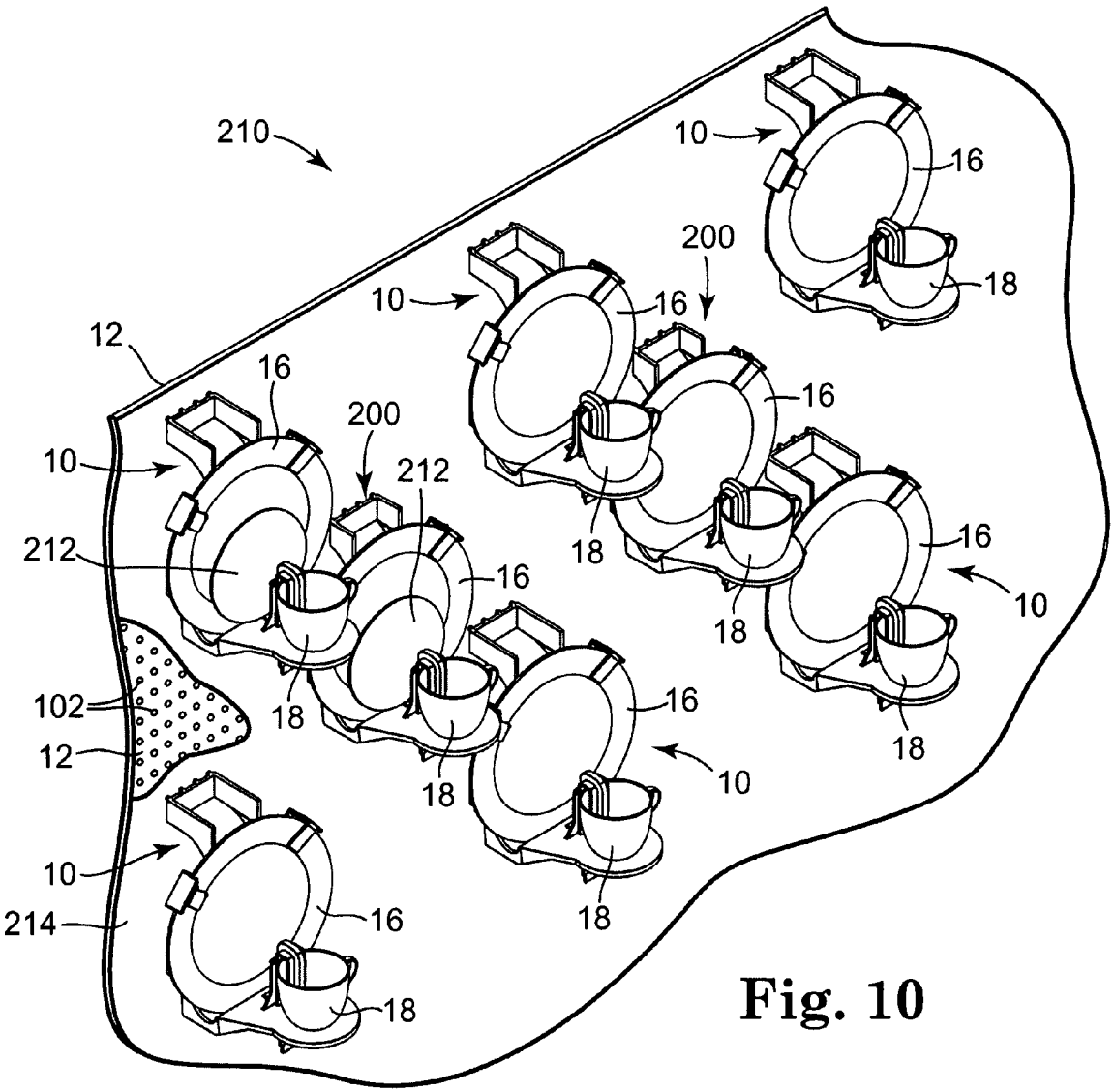
FIG. 10 is a perspective view of a dinnerware display including a plurality of dinnerware fixtures, according to the present invention.

Continuing to refer to the embodiment of FIG. 10, dinnerware display 210 is formed by hanging a plurality of dinnerware fixtures 10 and/or 200 from wall 12 each supporting a plate 16 and a cup 18. In one embodiment, plate 16 and cup 18 held by each fixture 10 and/or 200 is a different style, material, patterned, etc. plate 16 and cup 18. In one example, plate 16 and cup 18 held by a single dinnerware fixture 10 or 200 correspond with or compliment each other. In one embodiment, a smaller or secondary plate 212, bowl, or saucer is placed on dinnerware fixture 10 or 200 to rest on cup reception platform 32 adjacent cup mount support 140 and to lean back against plate 16. In this regard, additional corresponding dishware, such as a dinner plate, salad plate, bowl, etc. are also displayed on dinnerware fixture 10 or 200.

In one embodiment, deep dinnerware fixtures 10 are staggered and alternated with or positioned adjacent shallow dinnerware fixtures 200 such that a plate 16 held by a deep dinnerware fixture 10 extends partially in front of a plate 16 held by shallow dinnerware fixture 200. Due in part to this overlap of plates 16, dinnerware fixtures 10 and 200 can be placed nearer to one another than in an embodiment in which all dinnerware fixtures 10 and 200 are either shallow or deep. Therefore, more dinnerware 14 can be displayed to consumers in a given retail display area.

As illustrated in FIGS. 1 and 10, in one example, a backer paper or panel 214 is placed on wall 12 prior to positioning of dinnerware fixtures 10 and 200 on wall 12. More specifically, backer paper 214, as illustrated in FIGS. 1 and 10, is secured to wall 12 and includes cut-outs aligned with holes 102 of wall 12 that will receive pegs 100. In one embodiment, peg holes 102 in wall 12 that will not receive pegs 100 of dinnerware fixtures 10 and 200 are covered or blocked by backer paper 214 from consumer view. Accordingly, a more aesthetically pleasing overall display 210 is presented. In one example, backer paper 214 is printed with graphics or other indicia to further enhance display 210.

In one embodiment, dinnerware display 210 is positioned near the boxed or unboxed dinnerware corresponding to plates 16 and cup 18 displayed. With this in mind, a consumer viewing pates 16 and cups 18 of display 210 can easily locate the corresponding dinnerware goods for subsequent purchase.

A dinnerware fixture according to embodiments of the present invention provides for an aesthetically pleasing way of displaying dinnerware to a consumer audience. The adjustability of the dinnerware fixtures described herein allow the dinnerware fixture to accommodate plates and cups or glasses of various sizes and shapes. Accordingly, the dinnerware fixture initially assembled to receive a first type or size of plate and cup, can subsequently be adjusted and reused to receive and display a different type or size of plate and cup. The method of securing such plates and cups to each dinnerware fixture according to embodiments of the present invention also deters consumer handling of the dinnerware, which could lead to dinnerware breakage or other undesirable mishaps. Moreover, the staggered arrangement of deep and shallow dinnerware fixtures allows more plates and cups to be displayed in a given retail area. With this in mind, the embodiments of the dinnerware fixture described herein provide for an aesthetically pleasing and practical dinnerware display.

Although the invention has been described with respect to particular embodiments, such embodiments are for illustrative purposes only and should not be considered to limit the invention. Various alternatives and change will be apparent to those of ordinary skill in the art. For example, although generally described as being round or cylindrical, a light box can be formed in a variety of shapes and sizes. Additional modifications and changes will further be apparent to those of ordinary skill in the art.

What is claimed is:

1. A fixture for displaying dinnerware comprising:

a base configured to support a piece of dinnerware;

a track securely coupled to and extending generally perpendicular to the base;

a dinnerware mount at least partially received by and slidably coupled to the track such that the dinnerware mount can be slid along the track, the dinnerware mount including a first arm and a second arm extending radially from a vertex generally aligned with the track and defining an angle of less than 180 degrees therebetween in a plane parallel to the track, each of the first arm and the second arm defining a clasp for receiving a portion of the piece of dinnerware;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount.

2. The fixture of claim 1, wherein the dinnerware mount is a generally Y-shaped member.

3. The fixture of claim 1, wherein the dinnerware mount is homogenously formed of injection molded plastic.

4. The fixture of claim 1, wherein the dinnerware mount is adjustable to receive any one of a plurality of dinnerware pieces between the base and the first and second clasps of the dinnerware mount, and further wherein each of the plurality of dinnerware pieces is sized differently than the other of the plurality of dinnerware pieces.

5. The fixture of claim 1, wherein the base includes a plate reception portion and a cup reception platform, wherein the piece of dinnerware is a plate configured to be partially received by the plate reception portion, and the cup reception platform is configured to support a cup.

6. The fixture of claim 1, further comprising: a sign support member extending from the base and configured to support a sign relating to the piece of dinnerware.

7. The fixture of claim 1, wherein a portion of the clasp defined by the first arm angles back toward a remainder of the first arm, and a portion of the clasp defined by the second arm angles back toward a remainder of the second arm.

8. The fixture of claim 1, wherein the track includes an elongated slot, and the dinnerware mount is at least partially received within the slot to slidably couple the dinnerware mount to the track.

9. The fixture of claim 1, wherein the base includes a substantially planar bottom wall extending from the track to a cup reception platform spaced from and positioned in front of the track.

10. The fixture of claim 9, wherein the bottom wall is configured to at least partially support the piece of dinnerware.

11. The fixture of claim 1, wherein each of the first arm and the second arm extend further away from the base than a remainder of the dinnerware mount.

12. The fixture of claim 1, in combination with the piece of dinnerware, which is selectively maintained between the base and the dinnerware mount.

13. The fixture of claim 1, wherein the base includes a dinnerware reception portion including an elongated aperture configured to receive an edge of the dinnerware, the base defines a cup reception platform separate from the dinnerware reception portion, and the fixture further comprises a cup mount coupled to the cup reception portion and configured to secure the cup between the cup mount and the cup reception platform.

14. A fixture for displaying dinnerware comprising:

a base configured to support a piece of dinnerware;

a track coupled to and extending generally perpendicular to the base within a track plane; and a dinnerware mount slidably coupled to the track, the dinnerware mount including a first arm, a second arm, and a central point from which both the first and second arms symmetrically extend, each of the first arm and the second arm defining a clasp for receiving a portion of the piece of dinnerware, wherein the first arm, the second arm, and the central point are non-collinear in a plane parallel to the track plane;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount; and wherein the piece of dinnerware is a plate, and the base includes a plate reception portion including an elongated aperture configured to receive an edge of the plate.

15. The fixture of claim 14, in combination with the plate, wherein the plate is supported by the base, at least partially received by the first arm and the second arm, and an edge of the plate is received by the elongated aperture.

16. A fixture for displaying dinnerware comprising:

a base configured to support a piece of dinnerware;

a track coupled to and extending generally perpendicular to the base along a track axis;

a dinnerware mount slidably coupled to the track within a mount plane, the dinnerware mount including a first arm and a second arm extending from a point aligned with the track axis such that the first arm and the second arm exhibit reflectional symmetry with respect to the track axis within the mount plane and define equal but non-supplemental angles with respect to the track axis, each of the first arm and the second arm defining a clasp for receiving a portion of the piece of dinnerware;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount, the base includes a plate reception portion and a cup reception platform, and the piece of dinnerware is a plate configured to be partially received by the plate reception portion, and the cup reception platform is configured to support a cup, the fixture further comprising:

a cup mount coupled to the cup reception platform and configured to secure the cup between the cup mount and the cup reception platform.

17. The fixture of claim 16, wherein the cup mount includes a cup mount support coupled to the cup reception platform and a cup mount hook slidably coupled with the cup mount support, further wherein the cup mount hook slides with respect to the cup mount support to selectively secure the cup between the cup mount hook and the cup reception platform.

18. The fixture of claim 17, wherein each of the cup mount support and the cup mount hook are individually formed of injection molded plastic.

19. The fixture of claim 16, in combination with the piece of dinnerware, which is selectively maintained between the base and the dinnerware mount, and the cup, which is removably secured between the cup mount and the cup reception platform.

20. The fixture of claim 19, wherein the cup is a drinking vessel.

21. The fixture of claim 16, wherein the cup reception platform tapers as the cup reception portion extends away from the plate reception portion.

22. A fixture for displaying dinnerware comprising:

a base configured to support a piece of dinnerware;

a track securely coupled to and extending generally perpendicular to the base;

a dinnerware mount at least partially received by and slidably coupled to the track such that the dinnerware mount can be slid along the track, the dinnerware mount including a first arm and a second arm circumferentially spaced from one another, each of the first arm and the second arm defining a clasp for receiving a portion of the piece of dinnerware; and a plurality of pegs configured to hang the fixture from a peg board;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount.

23. A fixture for displaying dinnerware comprising:

a base configured to support a piece of dinnerware;

a track securely coupled to and extending generally perpendicular to the base; and a dinnerware mount at least partially received by and slidably coupled to the track such that the dinnerware mount can be slid along the track, the dinnerware mount including a first arm and a second arm circumferentially spaced from one another, each of the first arm and the second arm defining a clasp for receiving a portion of the piece of dinnerware;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount; and wherein the fixture is hung from a wall, and the fixture further comprises at least one spacer configured to maintain the track generally parallel to the wall.

24. The fixture of claim 23, wherein the track is formed by a back support coupled to the base, the back support including the track, a wall interface portion, and the at least one spacer.

25. A fixture for displaying dinnerware comprising:

a base configured to support a piece of dinnerware;

a track coupled to and extending generally perpendicular to the base;

a dinnerware mount slidably coupled to the track, the dinnerware mount including a first arm and a second arm circumferentially spaced from one another, each of the first arm and the second arm defining a clasp for receiving a portion of the piece of dinnerware;

wherein when the dinnerware mount is in a first position with respect to the track, the piece of dinnerware is maintained between the base and the dinnerware mount, and wherein when the dinnerware mount is in a second position with respect to the track, the piece of dinnerware is removable from between the base and the dinnerware mount, the fixture is hung from a wall, and the fixture further comprises:

at least one spacer configured to maintain the track generally parallel to the wall, wherein the track is formed by a back support coupled to the base, the back support including the track, a wall interface portion, and the at least one spacer;

wherein the back support is coupled to the base with a snap connection.

26. The fixture of claim 25, in combination with the piece of dinnerware, which is selectively maintained between the base and the dinnerware mount.

* * * * *